US009905915B2

(12) United States Patent
Asakawa

(10) Patent No.: US 9,905,915 B2
(45) Date of Patent: Feb. 27, 2018

(54) PATTERN ANTENNA

(71) Applicant: MegaChips Corporation, Osaka-shi (JP)

(72) Inventor: Koji Asakawa, Osaka (JP)

(73) Assignee: MegaChips Corporation, Osaka-shi (JP)

( * ) Notice: Subject to any disclaimer, the term of this patent is extended or adjusted under 35 U.S.C. 154(b) by 0 days.

(21) Appl. No.: 15/224,828

(22) Filed: Aug. 1, 2016

(65) Prior Publication Data

US 2017/0062936 A1 Mar. 2, 2017

(30) Foreign Application Priority Data

Aug. 26, 2015 (JP) ..... 2015-167131

(51) Int. Cl.

| | |
|---|---|
| ***H01Q 1/38*** | (2006.01) |
| ***H01Q 1/36*** | (2006.01) |
| ***H01Q 1/48*** | (2006.01) |
| ***H01Q 9/30*** | (2006.01) |
| *H01Q 1/24* | (2006.01) |

(52) U.S. Cl.

CPC ..... *H01Q 1/36* (2013.01); *H01Q 1/38* (2013.01); *H01Q 1/48* (2013.01); *H01Q 9/30* (2013.01); *H01Q 1/243* (2013.01)

(58) Field of Classification Search

CPC .. H01Q 1/36; H01Q 1/38; H01Q 1/48; H01Q 1/243; H01Q 9/30

See application file for complete search history.

(56) References Cited

U.S. PATENT DOCUMENTS

| | | | | |
|---|---|---|---|---|
| 6,166,694 A * | 12/2000 | Ying | ..... | H01Q 1/243 343/700 MS |
| 7,218,282 B2 * | 5/2007 | Humpfer | ..... | H01Q 1/38 343/700 MS |
| 2002/0024466 A1 * | 2/2002 | Masuda | ..... | H01Q 1/243 343/700 MS |

(Continued)

FOREIGN PATENT DOCUMENTS

| | | |
|---|---|---|
| JP | 2005-110109 | 4/2005 |
| JP | 2005-136784 | 5/2005 |

(Continued)

*Primary Examiner* — Dieu H Duong
(74) *Attorney, Agent, or Firm* — Oblon, McClelland, Maier & Neustadt, L.L.P.

(57) ABSTRACT

A pattern antenna, with excellent broadband antenna characteristics, that is formed in a small area is provided. The pattern antenna includes a substrate, a first ground portion formed on a first surface of the substrate, an antenna element portion, a protruding and short-circuiting portion, and a second ground portion. The antenna element portion includes a conductor pattern in which a plurality of bent portions are formed. The conductor pattern is formed on the first surface of the substrate and is electrically connected to the first ground portion. The protruding and short-circuiting portion includes a taper portion with a tapered shape, a protruding portion, and an extended portion extended toward a side opposite to a feed point as viewed in planar view. The second ground portion, with no contact with the taper portion, with such a shape that sandwiches at least a part of a tapered section of the taper portion as viewed in planar view.

3 Claims, 11 Drawing Sheets

(56) References Cited

U.S. PATENT DOCUMENTS

| | | | | |
|---|---|---|---|---|
| 2007/0069957 | A1* | 3/2007 | Ranta | H01Q 1/243<br>343/700 MS |
| 2016/0111791 | A1 | 4/2016 | Asakawa | |

FOREIGN PATENT DOCUMENTS

| | | | |
|---|---|---|---|
| JP | 2009-194783 | | 8/2009 |
| WO | WO 2015/019799 | A1 | 2/2015 |

* cited by examiner

1000

1000 freq (800 MHz to 1.200 GHz)

PATTERN ANTENNA

This application claims priority to Japanese Patent Application No. 2015-167131 filed on Aug. 26, 2015, the entire disclosure of which is hereby incorporated herein by reference (IBR).

BACKGROUND OF THE INVENTION

Field of the Invention

The present invention relates to a pattern antenna and an antenna device including a pattern antenna.

Description of the Background Art

In recent years, many small-size devices with wireless communication functions have been developed. Demands for miniaturizing an antenna to be incorporated in such a small-size device are growing.

Conventionally, F-shaped pattern antennas are widely used as antennas to be incorporated in small-size devices. An F-shaped pattern antenna is configured by forming patterns on the surface of a printed circuit board such that an antenna element is F-shaped. This enables an antenna for high frequencies to be formed in a relatively small area on the printed circuit board.

Furthermore, techniques for improving antenna characteristics by changing the shape of an antenna element (pattern shape on the printed circuit board) in the F-shaped pattern antenna have been proposed (e.g., see Patent Literature 1 (JP 2009-194783A)).

However, with the above conventional techniques, it may be difficult to achieve an antenna having desired antenna characteristics. This will be described with reference to FIG. 10.

FIG. 10 is a diagram showing an example of a conventional F-shaped pattern antenna 900. As shown in FIG. 10, the F-shaped pattern antenna 900 includes a substrate 91, a ground plane 92 formed with a pattern on the substrate 91, and an antenna element portion 93 connected to the ground plane 92. Also, as shown in FIG. 10, F-shaped pattern antenna 900 includes feed points 94 and 95.

When the wavelength of the carrier wave used by the F-shaped pattern antenna 900 is λ, adjusting the length L91 of the antenna element portion 93 shown in FIG. 10 to a length corresponding to approximately λ/4 achieves preferable antenna characteristics (frequency characteristics). Furthermore, when the F-shaped pattern antenna 900 is adjusted such that its input impedance matches 50Ω, adjusting the distance from the feed point 94 to the GND plane (the distance corresponding to the portion indicated by the arrow M1 in FIG. 10) and the position of the feed point 94 (the length L92 shown in FIG. 10) enables the capacitance component and the inductance component to be adjusted, thus allowing the input impedance to be closer to 50Ω.

The F-shaped pattern antenna 900 shown in FIG. 10 is configured to include the antenna element portion 93 extending in the vertical direction in FIG. 10, and the length L91 needs to be set to the length corresponding to approximately λ/4 This makes it difficult for the pattern antenna to be configured in smaller area while maintaining the antenna performance of the F-shaped pattern antenna 900.

In view of this, to configure a pattern antenna in smaller area while maintaining the length of the antenna element, it is conceivable to form the antenna element portion with bent portions (to make the antenna element portion meander line shaped) like the pattern antenna 900A shown in FIG. 11.

However, in the pattern antenna 900A shown in FIG. 11, space required for the short-circuiting portion 931A that extends toward the feed point 94A from the meander line shaped portion of the antenna element portion 93A that is positioned closest to the GND plane 92A is narrow. In other words, as shown in FIG. 11, adjustable area for the position of the short-circuiting portion 931A is limited, thus making it difficult to adjust the position of the short-circuiting portion 931A, achieve desired antenna characteristics, and perform appropriate impedance matching in the pattern antenna 900A.

While there is a strong demand for achieving a pattern antenna with excellent broadband characteristics, it is extremely difficult to achieve a small-sized pattern antenna with excellent broadband characteristics using the above-described conventional technique.

In view of the above problems, it is an object of the present invention to provide a pattern antenna, with excellent broadband antenna characteristics, that is formed in a small area.

SUMMARY

To solve the above problem, a first aspect of the invention provides a pattern antenna including a substrate, a first ground portion, an antenna element portion, a short-circuiting portion, a connection portion, and a second ground portion.

The first ground portion is formed on a first surface of the substrate.

The antenna element portion includes a conductor pattern in which a plurality of bent portions are formed. The conductor pattern is formed on the first surface of the substrate and is electrically connected to the first ground portion.

The short-circuiting portion includes a conductor pattern formed in a second surface, which is a different surface from the first surface. The conductor pattern is formed so as to at least partially overlap with the conductor pattern of the antenna element portion as viewed in planar view. The short-circuiting portion includes a taper portion with a tapered shape and an extended portion extended toward a side opposite to a feed point as viewed in planar view. The feed point is disposed at the tip of the taper portion or in proximity of the tip of the taper portion. The extended portion is electrically connected to the taper portion.

The connection portion is configured to electrically connect the conductor pattern of the antenna element portion with the conductor pattern of the short-circuiting portion.

The second ground portion, with no contact with the taper portion, with such a shape that sandwiches at least a part of a tapered section of the taper portion as viewed in planar view.

DESCRIPTION OF THE PREFERRED EMBODIMENTS

First Embodiment

A first embodiment will now be described with reference to the drawings.

Figure 1:
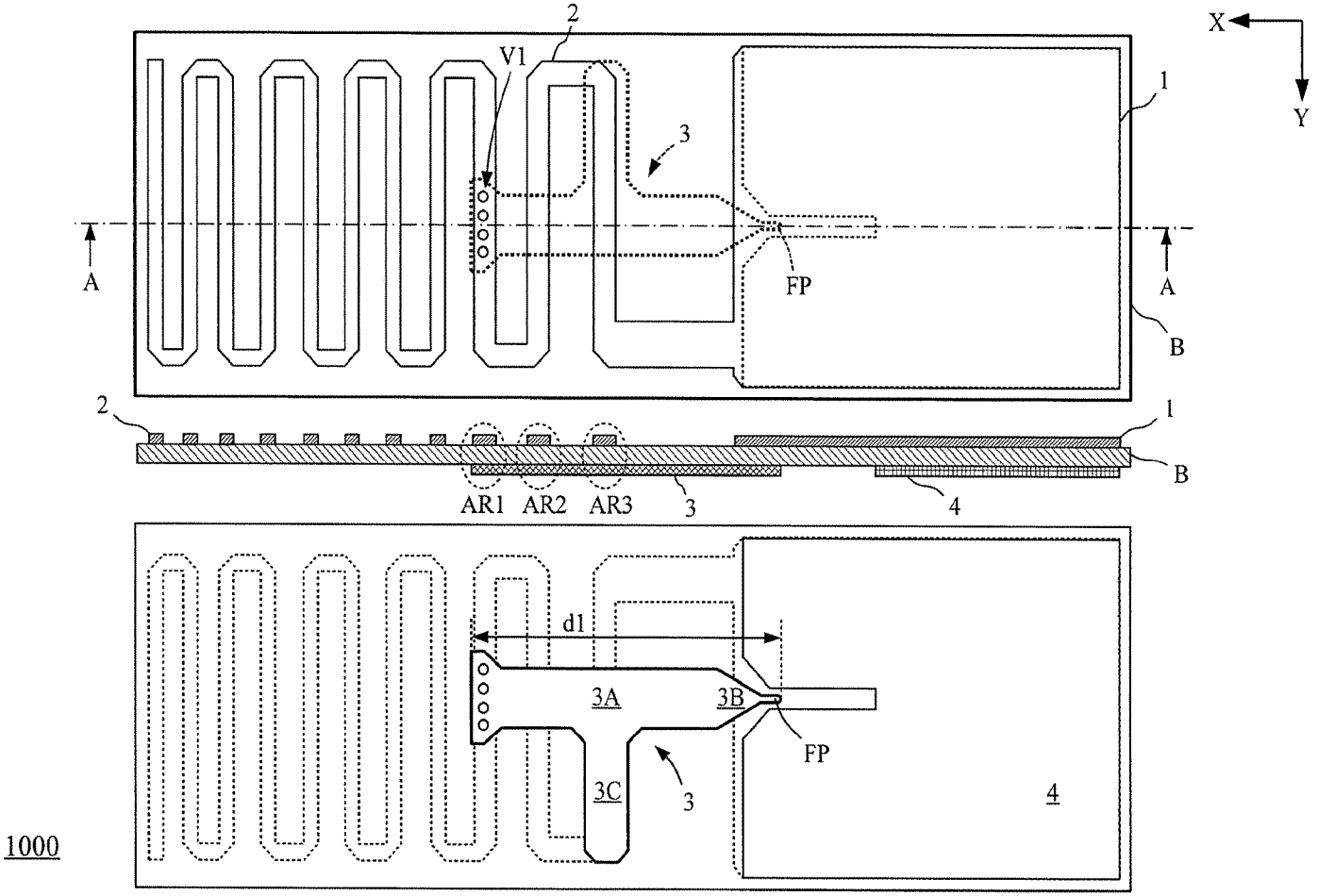
FIG. 1 is a schematic diagram of a pattern antenna 1000 according to a first embodiment.

FIG. 1 is a schematic diagram of a pattern antenna 1000 according to the first embodiment.

Figure 2:
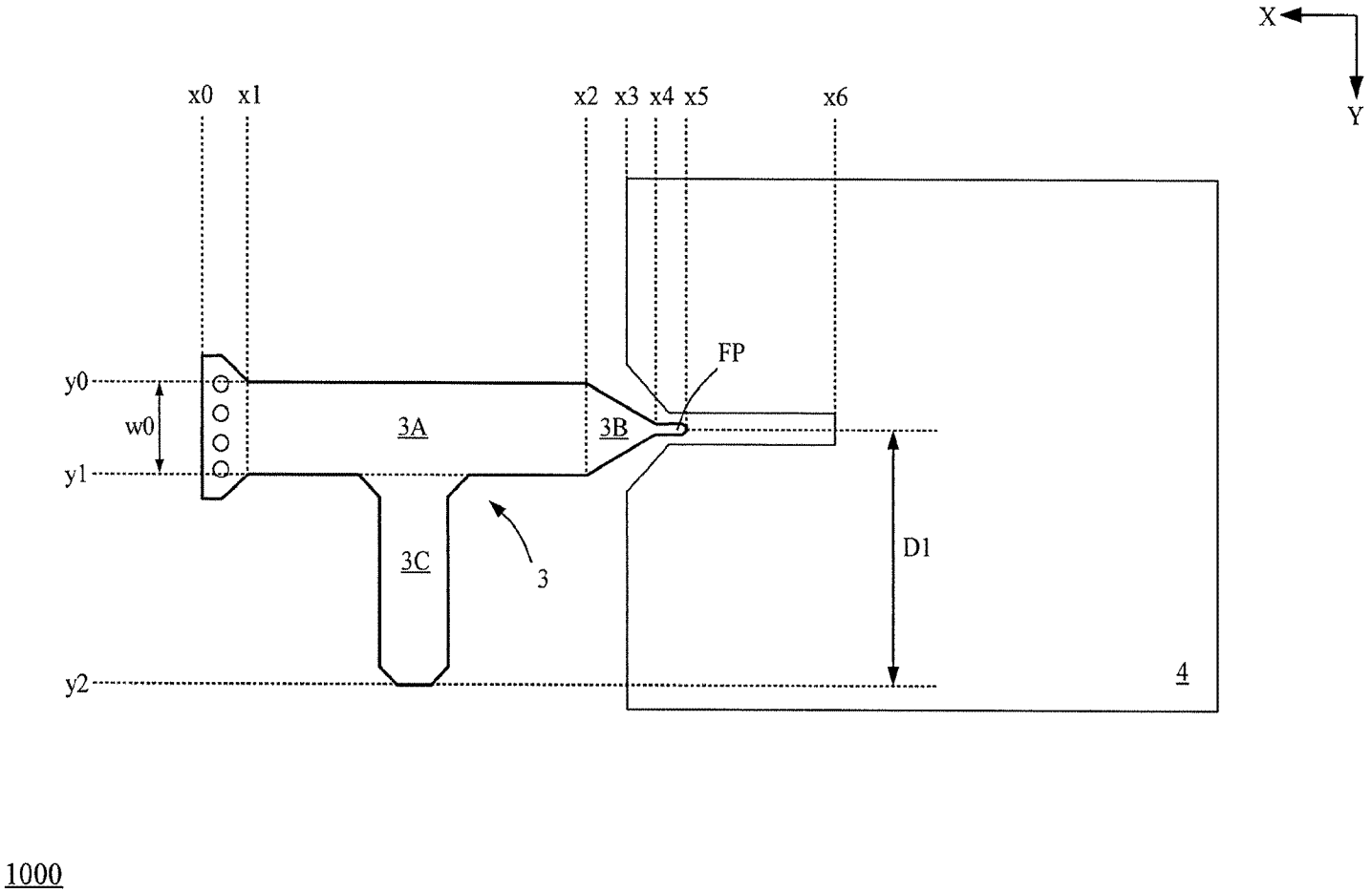
FIG. 2 is a schematic diagram of a protruding and short-circuiting portion 3 and a second ground portion 4 of the pattern antenna 1000.
Figure 3:
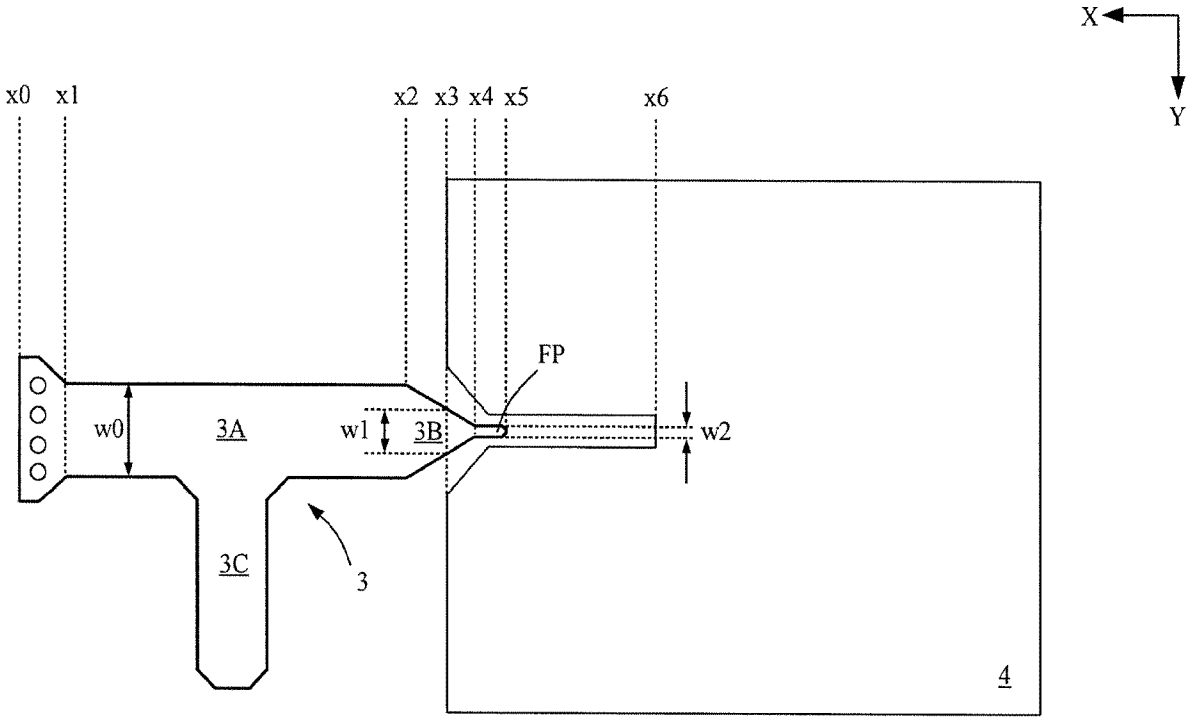
FIG. 3 is a schematic diagram of the protruding and short-circuiting portion 3 and the second ground portion 4 of the pattern antenna 1000.
Figure 4:
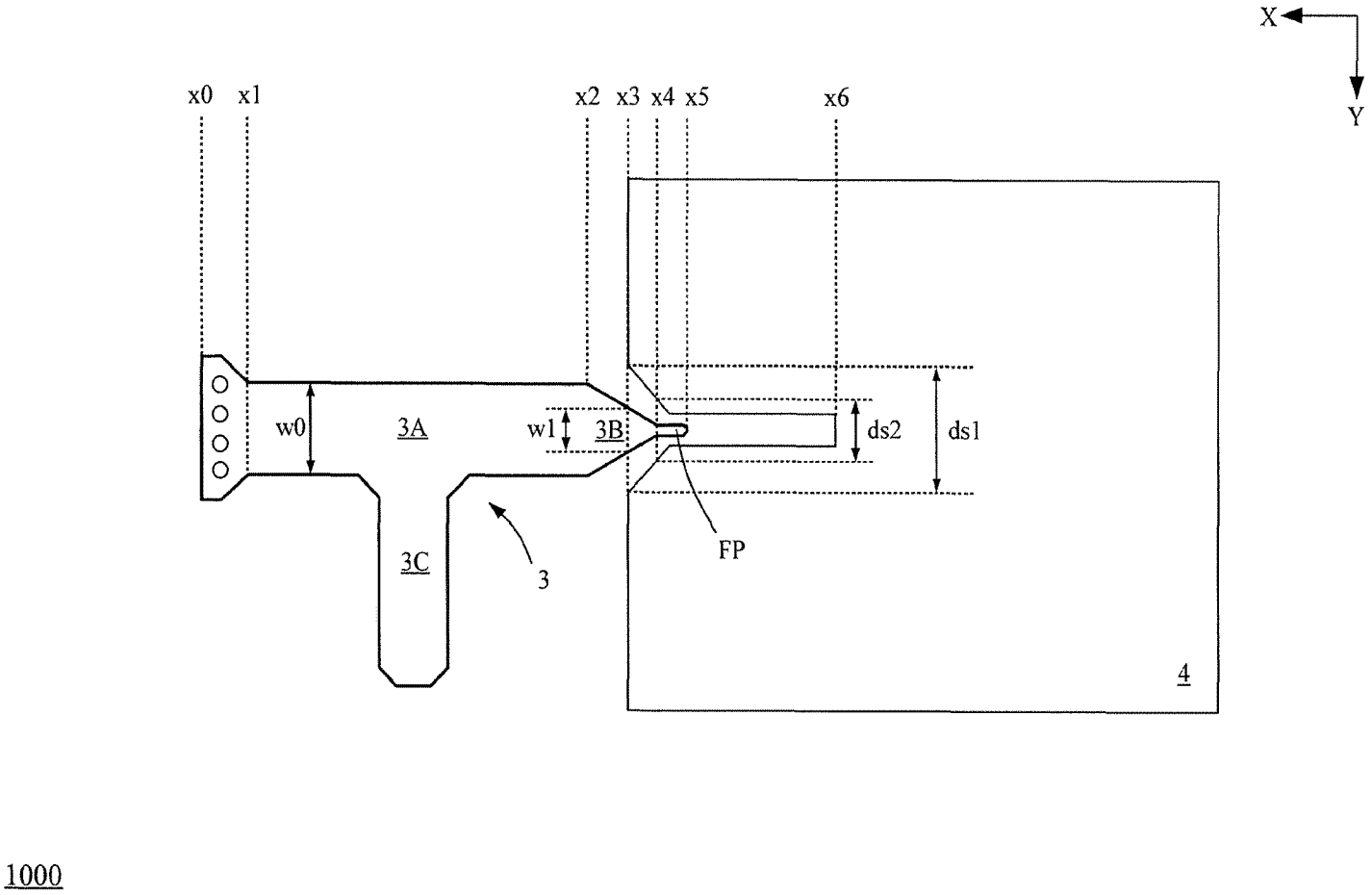
FIG. 4 is a schematic diagram of the protruding and short-circuiting portion 3 and the second ground portion 4 of the pattern antenna 1000.

FIGS. 2 to 4 are schematic diagrams of a protruding and short-circuiting portion 3 and a second ground portion 4 of the pattern antenna 1000.

The upper portion of FIG. 1 is a plan view of the pattern antenna 1000 of the first embodiment; the middle portion of FIG. 1 is an A-A sectional view; and the lower portion of FIG. 1 is a bottom view of the pattern antenna 1000. The X-axis and Y-axis are set as shown in FIG. 1.

The pattern antenna 1000, as shown in FIG. 1, includes a substrate B, a first ground portion 1 (first GND portion) that is formed with a pattern on the first surface of the substrate B, and an antenna element portion 2, which is meander line shaped, connected to the first ground portion 1. The pattern antenna 1000, as shown in FIG. 1, also includes a protruding and short-circuiting portion 3 and a second ground portion 4 (second GND portion 4) on the second surface that is the back surface of the first substrate.

The substrate B is, for example, a printed circuit board (e.g., a glass epoxy substrate). Patterns with conductors (e.g., copper foil) can be formed on the first surface and the second surface (surface different from the first surface) of the substrate B. For example, the substrate B is formed by a material (e.g., glass epoxy resin) with a specific dielectric constant of approximately 4.3. FIG. 1 illustrates a case where the first surface is the front surface of the substrate B and the second surface is the back surface of the substrate B (the surface opposite to the first surface); however, the present invention should not be limited to this structure. The substrate B may be a multi-layer substrate. The first surface may be formed on one of the multiple layers of the substrate B, and the second surface may be formed on another of the multiple layers of the substrate B. For ease of explanation, a case in FIG. 1 where the first surface is the front surface of the substrate B and the second surface is the back surface of the substrate B (the surface opposite to the first surface) will be described below.

The first ground portion 1, which is a pattern formed on the first surface of the substrate B, is connected to the GND potential.

The antenna element portion 2 is a meander-shaped pattern formed on the first surface of the substrate B (a pattern in which bent portions are repeatedly formed). The antenna element portion 2, as shown in FIG. 1, is a pattern with bent portions repeatedly formed in a manner that the pattern having the bent portions is extending in the positive X-axis direction from the end of the first ground portion 1. The pattern of the antenna element portion 2 is formed with a conductor (e.g., copper foil).

As shown in FIG. 1, through holes (via holes) V1 (connection portion) are formed on the pattern of the antenna element portion 2 to electrically connect the first surface to the second surface. For example, as shown in FIG. 1, four through holes are formed with the center of the four through holes on the line A-A. Note that the number of through holes should not be limited to four; the number of through holes may be a number other than four.

The protruding and short-circuiting portion 3 is formed on the second surface of the substrate B and includes an extended portion 3A, a taper portion 3B, and a protruding portion 3C.

As shown in FIGS. 1 to 3, the extended portion 3A is a conductor pattern extending in the negative X-axis direction from the position including the through holes V1 on the second surface. The extended portion 3A is connected with the taper portion 3B at an end in the negative X-axis direction (an end toward the second ground portion 4). As shown in FIG. 2, the extended portion 3A is formed such that its width in the Y-axis direction (the width w0 (=y1−y0) shown in FIG. 2) is substantially constant in the region from the X-coordinate x1 to the X-coordinate x2

As shown in FIGS. 1 to 3, the taper portion 3B is a conductor pattern extending from the end at the negative X-axis direction side of the taper portion 3B in the X-axis negative direction. The width (the length in the Y-axis direction) of the taper portion 3B becomes smaller toward the negative X-axis direction; that is, the taper portion 3B has a taper shape. A feed point FP is disposed at the tip of the taper portion 3B. As shown in FIG. 3, the taper portion 3B has a width w0 in the Y-axis direction at the X-coordinate x2, a width w1 in the Y-axis direction at the X-coordinate x3, and a width w2 in the Y-axis direction at the X-coordinate x4 (w0>w1>w2).

As shown in FIG. 3, the taper portion 3B is disposed such that a part of the tip portion of the taper portion 3B is arranged in such a way as to be sandwiched by the second ground portion 4 in the region between the X-coordinate x3 and the X-coordinate x5. The taper portion 3B is disposed such that a distance from any one of points on the contour (on the border) of the taper portion 3B disposed between X-coordinate x3 and X-coordinate x5 to the second ground portion 4 becomes smaller than a predetermined distance. In other words, the taper portion 3B is arranged close to the second ground portion 4 such that an area between the taper portion 3B and the second ground portion 4 included in the region between the X-coordinate x3 and the X-coordinate x5 becomes smaller than a predetermined value.

As shown in FIGS. 1 to 3, the protruding portion 3C is a conductor pattern extending, in the positive Y-axis direction, from the substantial center position of the extended portion 3A. As shown in FIG. 2, the protruding portion 3C is formed so as to have a length D1 in the Y-axis direction from the substantial center position, in the width direction (Y-axis direction), of the extended portion 3A to an end of the protruding portion 3C. For example, the length D1 may be substantially the same as the length of λ/4 where the length D1 may be, for example, substantially identical to the length of λ/4, where the wavelength corresponding to a frequency that a signal to be eliminated (a signal that the pattern antenna preferably prevents from transmitting or receiving) has is λ.

The protruding portion 3C, as shown in FIG. 1, is formed so as to overlap with the pattern of the antenna element portion 2 as viewed in planar view. Thus, the structure in which the pattern of the protruding and short-circuiting portion 3 overlaps with the pattern of the antenna element portion 2 as viewed in planar view is considered to be equivalent to a structure with capacitors disposed in parallel between the feed point FP of the protruding and short-circuiting portion 3 and the first ground portion 1, thereby enhancing the capacitance in the pattern antenna 1000.

The second ground portion 4, which is a pattern formed on the second surface of the substrate B, is connected to the GND potential.

As shown in FIGS. 1 to 4, the second ground portion 4 does not contact the taper portion 3B of the protruding and short-circuiting portion 3, and is formed so as to sandwich at least a part of the tapered section of the taper portion 3B as viewed in planar view.

The second ground portion 4 has a shape that allows a region for disposing the taper portion 3B to be left between the X-coordinate x3 and the X-coordinate x5. The second ground portion 4 is formed using a conductor pattern such that the region between the second ground portion 4 and the taper portion 3B satisfies relations below; that is, as shown in FIG. 4, the second ground portion 4 is formed such that the region between the second ground portion 4 and the taper portion 3B satisfies the following relations:

$$ds1>ds2$$

$$ds1>w1$$

$$ds29>w2$$

where ds1 is a distance, in the Y-axis direction at the X-coordinate x3, of a space defined by the second ground portion 4, ds2 is a distance, in the Y-axis direction at the X-coordinate x4, of a space defined by the second ground portion 4, w1 is a width, in the Y-axis direction at the X-coordinate x3, of the taper portion 3B, and w2 is a width, in the Y-axis direction at the X-coordinate x4, of the taper portion 3B.

Note that the second ground portion 4 may be formed such that a shape of a region between the second ground portion 4 and the protruding and short-circuiting portion 3, which is formed between the X-coordinate x5 and the X-coordinate x6, is a shape other than shapes shown in FIGS. 1 to 4. Also, the region between the second ground portion 4 and the protruding and short-circuiting portion 3 may have a shape that allows electronic component(s) and circuit(s), such as IC chip(s) or LSI chip(s), necessary for operating the pattern antenna 1000 to be appropriately disposed in the region.

Figure 11:
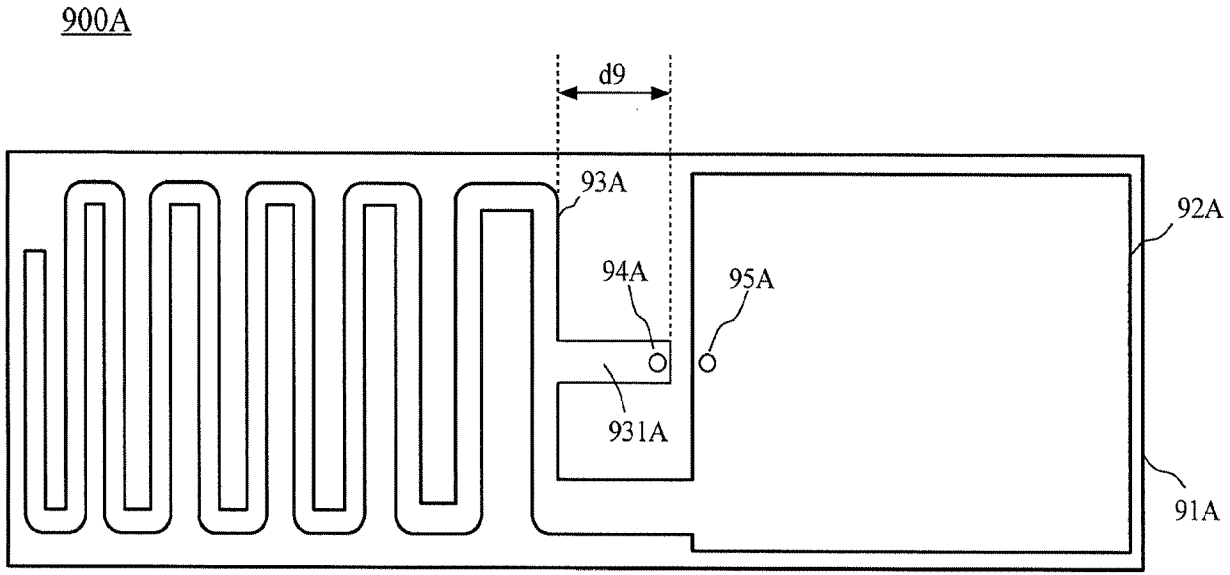
FIG. 11 is a diagram showing an example of a pattern antenna 900A.

In the pattern antenna 1000 with the above-described structure, the protruding and short-circuiting portion 3 is formed on the second surface different from the first surface on which the pattern of the antenna element portion 2 is formed, thereby enabling the length of the protruding and short-circuiting portion 3 to be long. The length d1 (the length in the X-axis direction) of the protruding and short-circuiting portion 3 in the pattern antenna 1000 as shown in FIG. 1 is much longer than the length d9 of the short-circuiting portion 931A in the pattern antenna, as shown in FIG. 11, in which the antenna element portion 93A and the short-circuiting portion 931A are both formed on the first surface.

Thus, the pattern antenna 1000 achieves improved antenna characteristics. In other words, in the pattern antenna 1000, the antenna element portion 2 on the first surface and the protruding and short-circuiting portion 3 on the second surface are disposed in a manner that the substrate B (e.g., a substrate with a relative permittivity of approximately 4.3) is sandwiched by the antenna element portion 2 and the protruding and short-circuiting portion 3, and a part of the antenna element portion 2 on the first surface overlaps with a part of the protruding and short-circuiting portion 3 on the second surface as viewed in planar view, thus producing capacitive coupling. More specifically, in the areas AR1, AR2 and AR3 in the A-A sectional view of FIG. 1 (the middle portion of FIG. 1), the conductor pattern of the antenna element portion 2 and the conductor pattern of the protruding and short-circuiting portion 3 are disposed in a manner that the substrate B is sandwiched by the antenna element portion 2 and the protruding and short-circuiting portion 3. Thus, the above-described structure in the areas AR1, AR2 and AR3 can be considered to be equivalent to a structure with capacitors disposed in parallel between the antenna element portion 2 and the first ground portion 1. Thus, in the pattern antenna 1000, forming the protruding and short-circuiting portion 3 as shown in FIG. 1 produces capacitive coupling, thereby improving the antenna characteristics. Furthermore, in the pattern antenna 1000, adjusting the width of the protruding and short-circuiting portion 3 enables the strength of capacitive coupling to be changed, thus allowing desired antenna characteristics to be achieved easily. Furthermore, the pattern antenna 1000 has the protruding and short-circuiting portion 3 formed on the second surface different from the first surface, thus reducing the area required to form the short-circuiting portion. This enables the pattern antenna 1000 achieving desired antenna characteristics to be formed in a small area.

In the pattern antenna 1000, a distance from the center in the width direction (Y-axis direction) of the protruding and short-circuiting portion 3 to the tip of the protruding portion 3C is set to be a quarter of the wavelength of the spurious signal, thereby preventing the spurious signal from propagating toward the feed point of the pattern antenna 1000.

Thus, providing the protruding portion 3C as described above in the pattern antenna 1000 lowers the antenna sensitivity for transmitting and/or receiving spurious frequency components, thereby improving the antenna characteristics of the pattern antenna 1000.

Also, in the pattern antenna 1000, the protruding and short-circuiting portion 3 includes the taper portion 3B, and a part of the tip portion (feed point) of the taper portion 3B is arranged in such a way as to be sandwiched by the second ground portion 4 formed on the second surface of the substrate B. This achieves an antenna with excellent broadband antenna characteristics.

Antenna Characteristics

The actual antenna characteristics of the pattern antenna 1000 will now be described.

Figure 5:
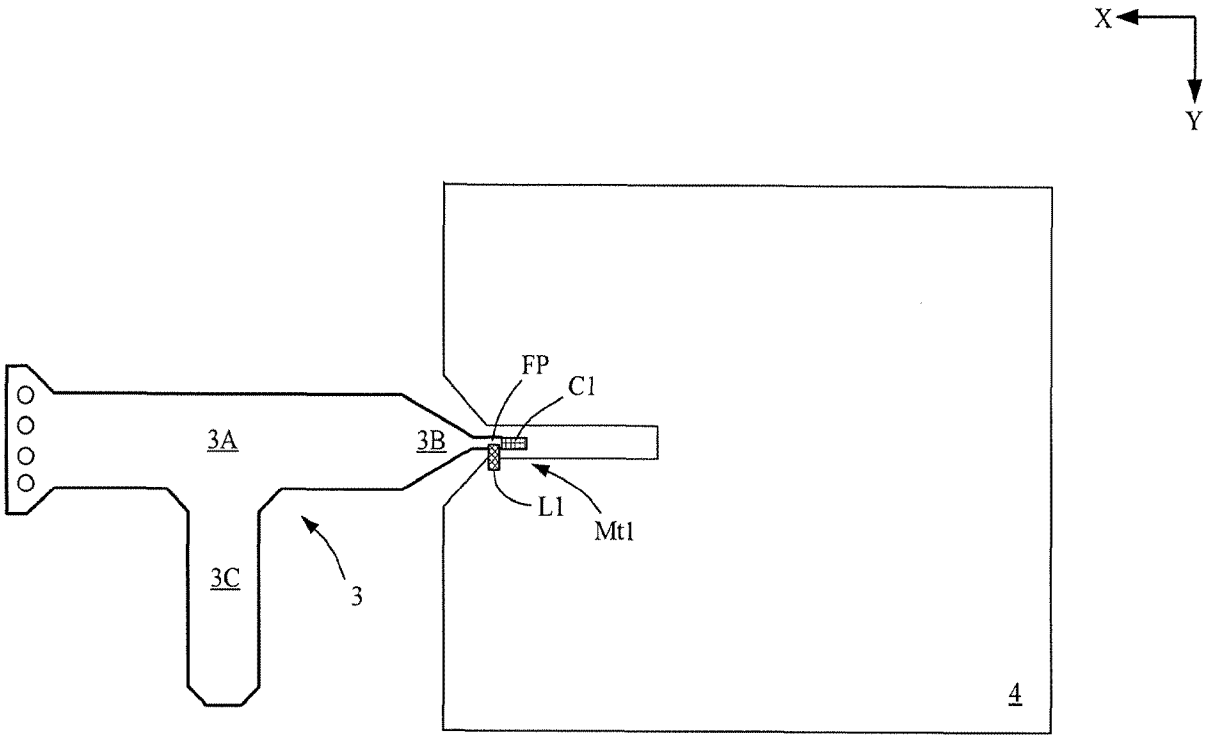
FIG. 5 is a schematic diagram of the protruding and short-circuiting portion 3 and the second ground portion 4 of the pattern antenna 1000 and a coil L1 and a capacitor C1 that constitute a matching circuit Mt1.

FIG. 5 is a schematic diagram of the protruding and short-circuiting portion 3 and the second ground portion 4 of the pattern antenna 1000 and a coil L1 and a capacitor C1 that constitute a matching circuit Mt1.

Figure 6:
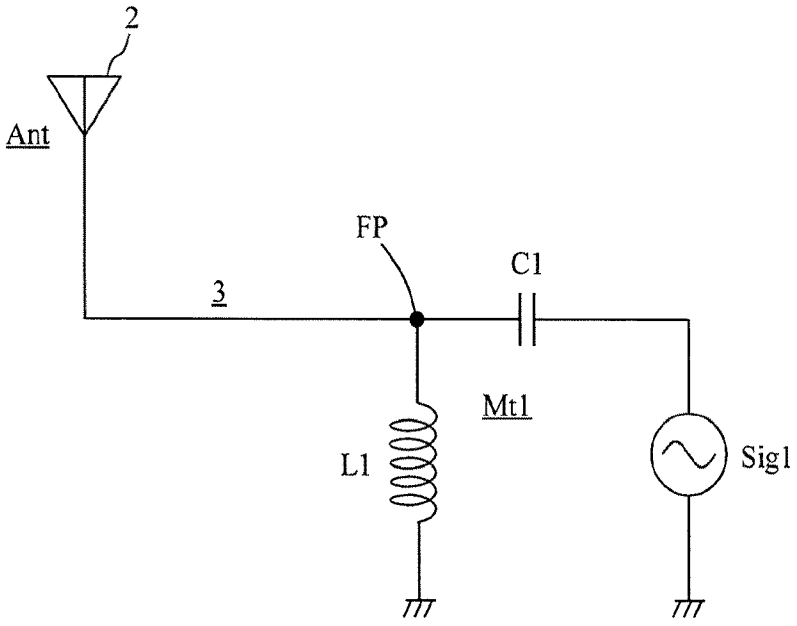
FIG. 6 is a schematic diagram of an equivalent circuit in which the matching circuit Mt1 and a signal source Sig1 are connected to the pattern antenna 1000.

FIG. 6 is a schematic diagram of an equivalent circuit in which the matching circuit Mt1 and a signal source Sig1 are connected to the pattern antenna 1000.

As shown in FIG. 5, the coil L1 is disposed between the tip portion (e.g., the feed point FP) of the taper portion 3B of the protruding and short-circuiting portion 3 and the second ground portion 4 that is disposed in the same direction (In FIG. 5, the positive Y-axis direction) as a direction in which the protruding portion 3C is disposed.

As shown in FIG. 5, an end of the capacitor C1 is connected to the tip portion (e.g., the feed point FP) of the taper portion 3B of the protruding and short-circuiting portion 3, and the other end of the capacitor C1 is connected to the signal source (signal source for an antenna) (not shown).

Connecting the coil L1 and the capacitor C1 as described above achieves a circuit equivalent to the equivalent circuit shown in FIG. 6.

In one example, an inductance value L1 of the coil L1 and a capacitance value C1 of the capacitor C1 is set as follows:

$$L1=15\ [nH]$$

$$C1=1.8\ [pF].$$

The characteristics of the pattern antenna 1000 will now be compared with the characteristics of a sleeve antenna commonly used as a half-wavelength dipole antenna.

Figure 7:
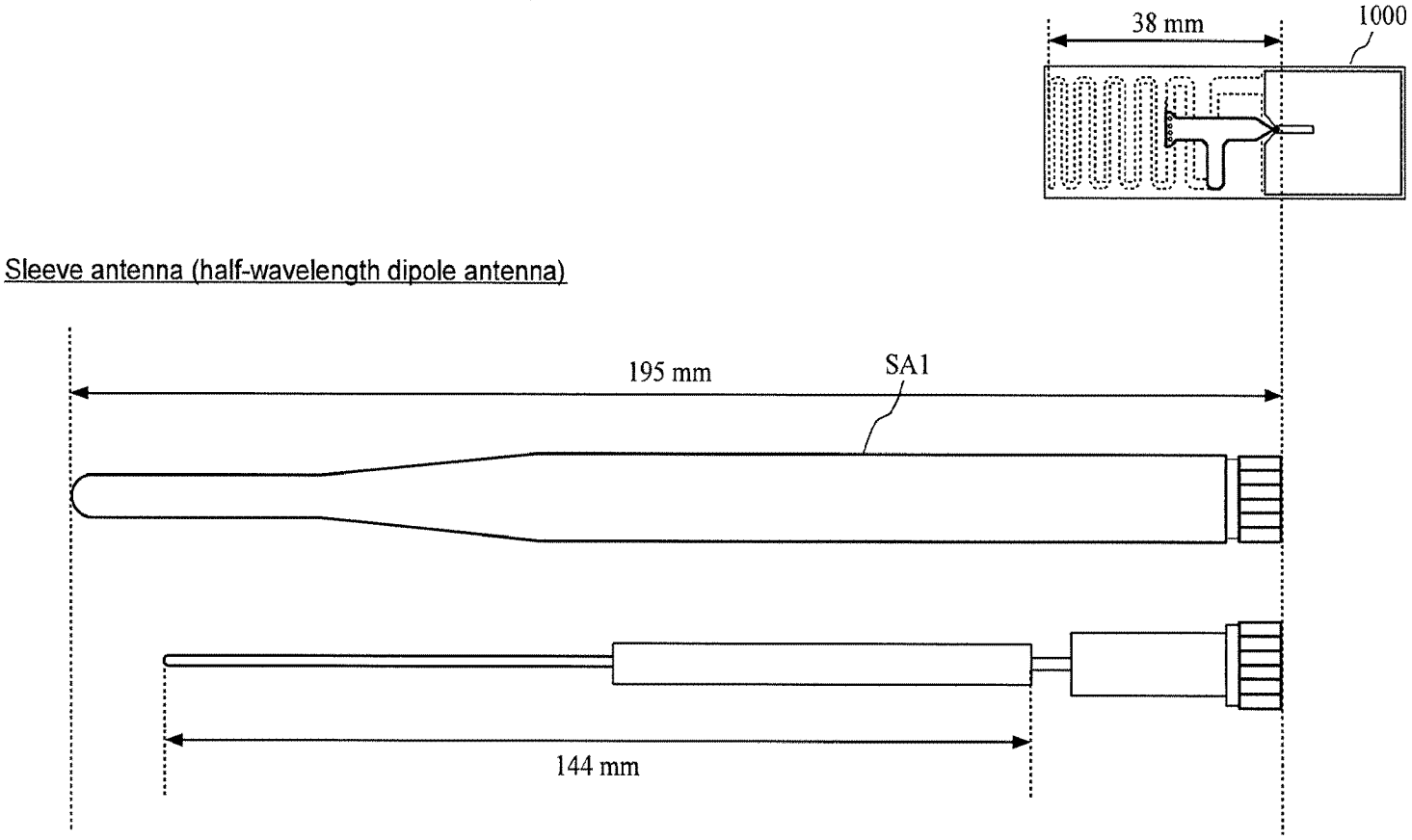
FIG. 7 is a diagram showing the pattern antenna 1000 and a sleeve antenna SA1 (half-wavelength dipole antenna).

FIG. 7 is a diagram showing the pattern antenna 1000 and a sleeve antenna SA1 (half-wavelength dipole antenna). To clearly compare the sizes of the two antenna, the pattern antenna 1000 and the sleeve antenna SA1 (half-wavelength dipole antenna) are shown on the same scale in FIG. 7. The lower portion of FIG. 7 shows the outside appearance of the sleeve antenna SA1 and the inner structure of the sleeve antenna SA1.

As shown in FIG. 7, the size of the pattern antenna 1000 is significantly smaller than that of the sleeve antenna SA1.

Figure 8:
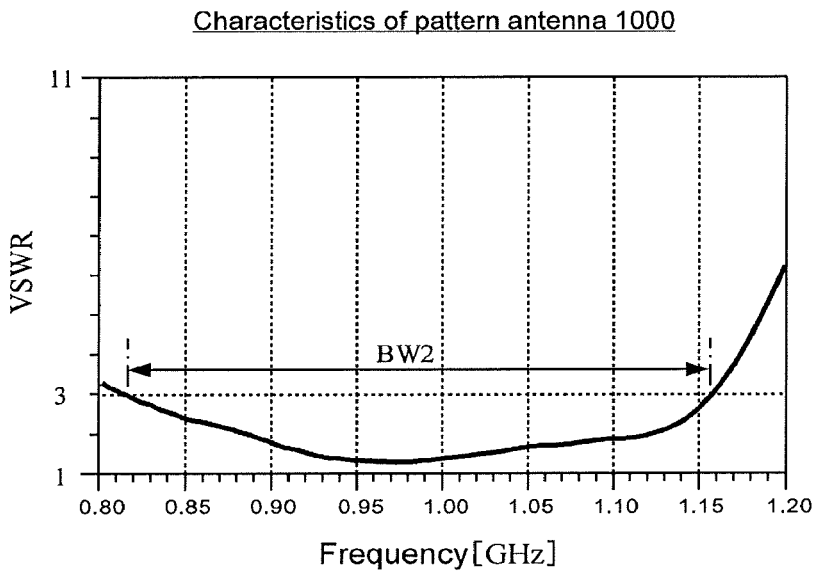
FIG. 8 is a diagram showing antenna characteristics (Frequency-VSWR (voltage standing wave ratio) characteristics) of the pattern antenna 1000 (the upper portion of FIG. 8) and antenna characteristics (Frequency-VSWR (voltage standing wave ratio) characteristics) of the sleeve antenna SA1 (the lower portion of FIG. 8).
Figure 8:
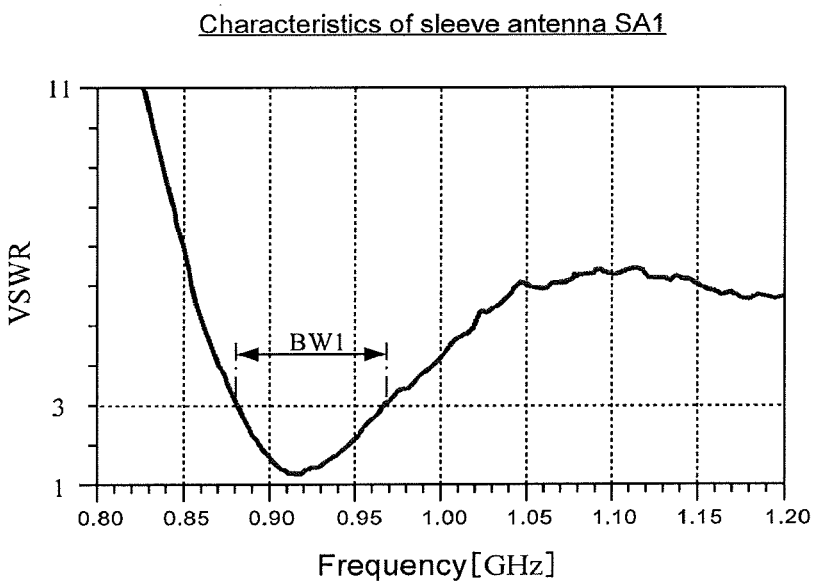

FIG. 8 is a diagram showing antenna characteristics (Frequency-VSWR (voltage standing wave ratio) characteristics) of the pattern antenna 1000 (the upper portion of FIG. 8) and antenna characteristics (Frequency-VSWR (voltage standing wave ratio) characteristics) of the sleeve antenna SA1 (the lower portion of FIG. 8).

A frequency band where VSWRs (voltage standing wave ratios) are less than or equal to "3" is typically determined to be a frequency band in which an antenna can appropriately function (hereinafter referred to as "antenna-available frequency band"). As shown in FIG. 8, the antenna-available frequency band of the pattern antenna 1000 is three or more times wider than that of the sleeve antenna SA1.

As understood from FIG. 8, the pattern antenna 1000 with the above-described structure has a significantly small size and extremely excellent antenna characteristics as compared with the sleeve antenna SA1.

Figure 9:
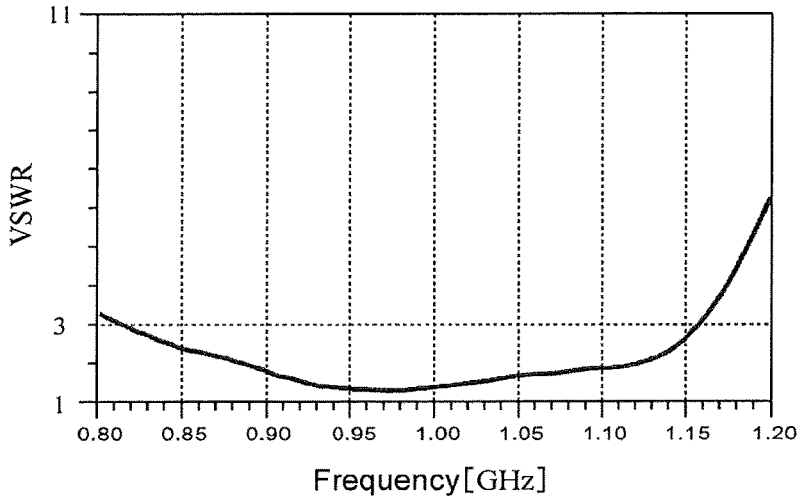
FIG. 9 is a diagram showing antenna characteristics (Frequency-VSWR (voltage standing wave ratio) characteristics) of the pattern antenna 1000 (the upper portion of FIG. 9) and a Smith chart of input impedance of the pattern antenna 1000 (the lower portion of FIG. 9).
Figure 9:
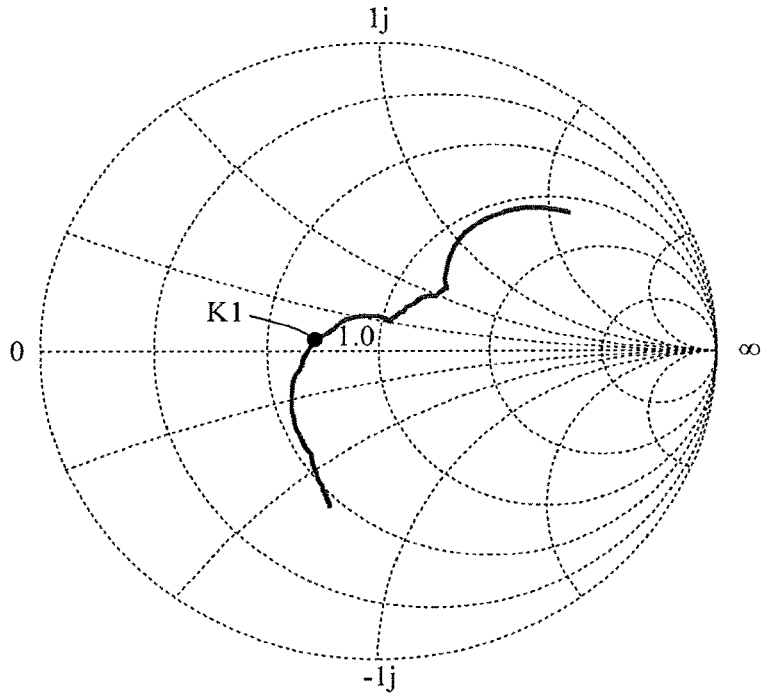
Figure 10:
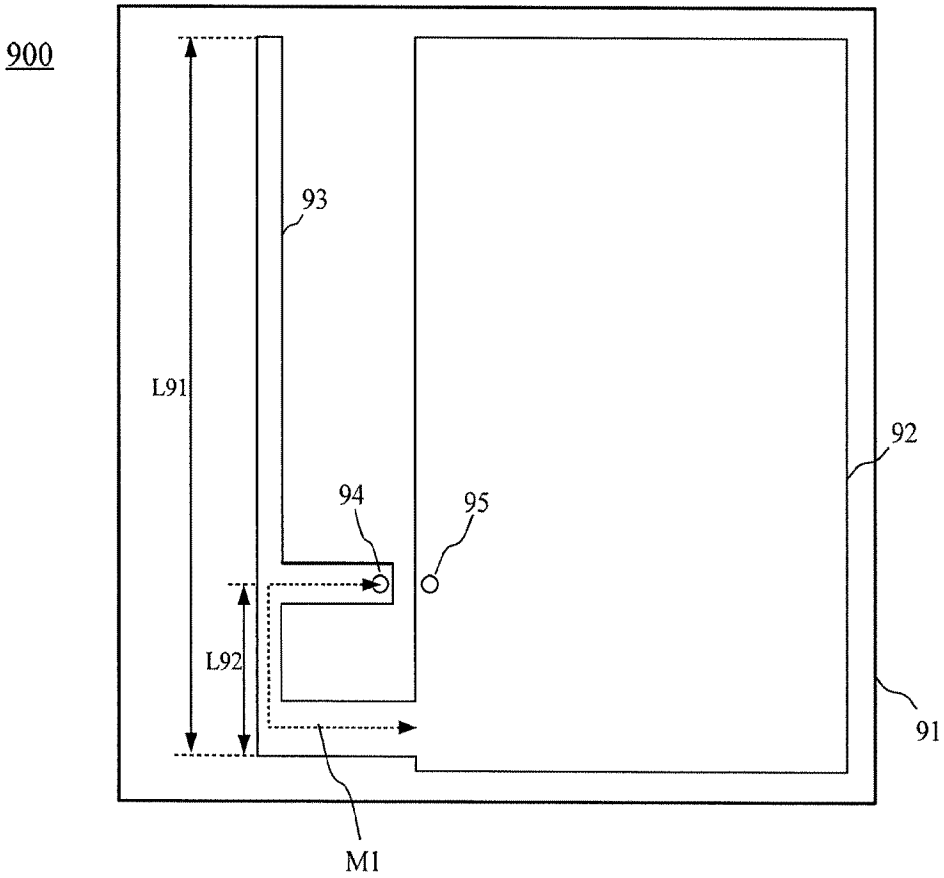
FIG. 10 is a diagram showing an example of a conventional F-shaped pattern antenna 900.

FIG. 9 is a diagram showing antenna characteristics (Frequency-VSWR (voltage standing wave ratio) characteristics) of the pattern antenna 1000 (the upper portion of FIG. 9) and a Smith chart of input impedance of the pattern antenna 1000 (the lower portion of FIG. 9).

As understood from the diagram showing the Frequency-VSWR (voltage standing wave ratio) characteristics in FIG. 9, the pattern antenna 1000 has a significantly wide antenna-available frequency band.

The lower portion of FIG. 9 shows input impedance characteristics in a frequency range from 800 MHz to 1.2 GHz.

Point K1 depicted in the Smith chart of the input impedance in FIG. 9 (the lower portion of FIG. 9) indicates the input impedance of the pattern antenna 1000 at 920 MHz. More specifically, the input impedance Z of the pattern antenna 1000 at 920 MHz is expressed in complex representation as follows:

$$Z=34.263+j\times1.768$$

where "j" is the imaginary unit.

As shown in the lower portion of FIG. 9, the input impedance characteristics of the pattern antenna 1000 are also extremely excellent in a wide range of frequency band.

As described above, in the pattern antenna 1000, the protruding and short-circuiting portion 3 is provided on the second surface different from the first surface on which the antenna element portion 2 is formed, and furthermore the second ground portion 4 is provided so as to sandwich the taper portion 3B of the protruding and short-circuiting portion 3. In the pattern antenna 1000, as shown in FIG. 5, the coil L1 constituting the matching circuit Mt1 is disposed in the Y-axis direction between the tip portion of the taper portion 3B and the second ground portion 4 that is disposed in the same direction (In FIG. 5, the positive Y-axis direction) as a direction in which the protruding portion 3C is disposed. As shown in FIG. 5, an end of the capacitor C1 is connected to the tip portion of the taper portion 3B, and the other end of the capacitor C1 is connected to the signal source. The pattern antenna 1000 with the above-described structure has extremely excellent antenna characteristics in a broad frequency band. The above-described structure of the pattern antenna 1000 allows the pattern antenna 1000 to be formed in a small area.

The above-described pattern antenna 1000 is merely one example; the present invention should not be limited to the above-described structure.

For example, the shape, size, or the like of a region where the protruding and short-circuiting portion 3 of the pattern antenna 1000 overlaps with the antenna element portion 2 formed on the first surface as viewed in a planar view may be changed.

Also, the length of the meander line shaped portion in the antenna element portion 2 may be adjusted in accordance with a frequency (or frequencies) with which an antenna operates. To adjust the impedance characteristics, the shape, size, width, or the like of all or part of the protruding and short-circuiting portion 3 may be adjusted.

To adjust the antenna-available frequency band, the size, shape, or the like of the taper portion 3B of the protruding and short-circuiting portion 3 may be adjusted.

The impedance characteristics or the antenna-available frequency band may be adjusted by setting the inductance value L1 of the coil L1 included in the matching circuit Mt1 and the capacitance value C1 of the capacitor C1 included in the matching circuit Mt1 to values different from those described above.

The terms "substantially the same" and "substantial center" used in the above embodiments intend to permit an error occurring when control or the like is executed using a target value (or a design value) of being the same or using a target of being the center, or also permit an error determined depending on the resolution of the apparatus, and "substantially the same" or "substantial center" can include a range that a person skilled in the art determines (or recognizes) as being the same or being center. Also, other terms including "substantial" or "substantially" intend to cover a permissible range determined depending on measurement error(s), design error(s), manufacturing error(s), or the like.

In some example(s) in the above embodiments, only relevant member(s), among the constituent members of the embodiments of the present invention, necessary for describing the present invention are simplified and shown. Thus, the above embodiment(s) may include any constituent member that is not shown in the above embodiment(s). Also, in the above embodiment(s) and/or drawing(s), the dimensions of the members may not be faithfully (strictly) identical to their actual dimensions, their actual dimension ratios, or the like. Thus, the dimension(s) and/or the dimension ratio(s) may be changed without departing from the scope and the spirit of the invention.

The specific structures described in the above embodiments are mere examples of the present invention, and may be changed and modified variously without departing from the scope and the spirit of the invention.

APPENDIXES

The present invention may also be expressed in the following forms. A first aspect of the invention provides a pattern antenna including a substrate, a first ground portion, an antenna element portion, a short-circuiting portion, a connection portion, and a second ground portion.

The first ground portion is formed on a first surface of the substrate.

The antenna element portion includes a conductor pattern in which a plurality of bent portions are formed. The conductor pattern is formed on the first surface of the substrate and is electrically connected to the first ground portion.

The short-circuiting portion includes a conductor pattern formed in a second surface, which is a different surface from the first surface. The conductor pattern is formed so as to at least partially overlap with the conductor pattern of the antenna element portion as viewed in planar view. The short-circuiting portion includes a taper portion with a tapered shape and an extended portion extended toward a side opposite to a feed point as viewed in planar view. The feed point is disposed at the tip of the taper portion or in proximity of the tip of the taper portion. The extended portion is electrically connected to the taper portion.

The connection portion is configured to electrically connect the conductor pattern of the antenna element portion with the conductor pattern of the short-circuiting portion.

The second ground portion, with no contact with the taper portion, with such a shape that sandwiches at least a part of a tapered section of the taper portion as viewed in planar view.

The pattern antenna includes the short-circuiting portion formed on the second surface, which is a different surface from the first surface, and the second ground portion in a manner that the second ground portion sandwiches a tapered section of the taper portion. In the pattern antenna with such a configuration, the taper portion secures various paths for current to flow, and furthermore the second ground portion, which is formed on the second surface, close to the taper portion achieves excellent impedance characteristics. As a result, the pattern antenna has excellent broadband antenna characteristics. In addition, the above-described configuration allows the pattern antenna to be formed in a small area.

Note that the second ground portion may be formed using one conductor pattern; alternatively the second ground portion may be formed by connecting a plurality of conductor patterns.

A second aspect of the present invention provides the pattern antenna of the first aspect of the present invention further including a protruding portion electrically connected to the short-circuiting portion on the second surface of the substrate. The protruding portion includes a conductor pattern formed so as to at least partially overlap with the conductor pattern of the antenna element portion as viewed in planar view.

The pattern antenna includes the short-circuiting portion and the protruding portion that are formed on the second surface, which is a different surface from the first surface, and further includes the second ground portion in a manner that the second ground portion sandwiches a tapered section of the taper portion. In the pattern antenna with such a configuration, the taper portion secures various paths for current to flow, and furthermore the second ground portion, which is formed on the second surface, close to the taper portion achieves excellent impedance characteristics. As a result, the pattern antenna has excellent broadband antenna characteristics. In addition, the above-described configuration allows the pattern antenna to be formed in a small area.

A third aspect of the present invention provides the pattern antenna of the second aspect of the present invention in which the taper portion has a shape that forms an substantially isosceles triangle symmetrical with respect to a center straight line connecting the tip of the taper portion and the center of the tapered section of the taper portion as viewed in planar view.

The taper portion and the second ground portion are disposed such that relations below are satisfied:

$$d1<d2$$

$$wb1<wb2$$

$$wb1<d1$$

$$wb2<d2$$

where a first intersection and a second intersection are two points at which a straight line orthogonal to the center straight line at the tip of the taper portion intersects a contour line of the second ground portion in the tip of the taper portion as viewed in planar view, a third intersection and a fourth intersection are two points at which a straight line, which includes a first reference point on the center straight line, the first reference point being included in a region sandwiched by the second ground portion and also being included in the taper portion as viewed in planar view, orthogonal to the center straight line intersects a contour line of the second ground portion, d1 is a distance from the first intersection to the second intersection as viewed in planar view, d2 is a distance from the third intersection to the fourth intersection as viewed in planar view, wb1 is a width, on a straight line connecting the first intersection and the second intersection, of the taper portion as viewed in planar view, and wb2 is a width, on a straight line connecting the third intersection and the fourth intersection, of the taper portion as viewed in planar view.

The pattern antenna includes the short-circuiting portion and the protruding portion that are formed on the second surface, which is a different surface from the first surface, and further includes the second ground portion in a manner that the second ground portion sandwiches a tapered section of the taper portion. In the pattern antenna with such a configuration, the taper portion secures various paths for current to flow, and furthermore the second ground portion, which is formed on the second surface, close to the taper portion achieves excellent impedance characteristics. As a result, the pattern antenna has excellent broadband antenna characteristics. In addition, the above-described configuration allows the pattern antenna to be formed in a small area.

Note that the second ground portion may be formed using one conductor pattern; alternatively the second ground portion may be formed by connecting a plurality of conductor patterns.

A fourth aspect of the present invention provides the pattern antenna of the second aspect of the present invention further including a coil an end of which is connected to the tip of the taper portion and the other end of which is connected to a point on the second ground portion that is disposed in the same direction as a direction in which the protruding portion is disposed, as viewed in planar view.

The pattern antenna includes the short-circuiting portion and the protruding portion that are formed on the second surface, which is a different surface from the first surface, and further includes the second ground portion in a manner that the second ground portion sandwiches a tapered section of the taper portion. Furthermore, in the pattern antenna, the coil (e.g., the coil constituting a matching circuit) is disposed between a point on the second ground portion that is disposed in the same direction as a direction in which the protruding portion is disposed and a point included in the tip of the taper portion. This achieves excellent broadband antenna characteristics in the pattern antenna. Also, in the pattern antenna, connecting an end of a capacitor to the point included in the tip of the taper portion and the other end of the capacitor to a signal source allows a matching circuit to be constituted with the above-described coil.

A fifth aspect of the present invention provides the pattern antenna of the third aspect of the present invention further including a coil an end of which is connected to the tip of the taper portion and the other end of which is connected to a point on the second ground portion. The point is disposed in a region including the protruding portion among two regions that are defined by splitting a space including the pattern antenna by the center straight line, as viewed in planar view.

The pattern antenna includes the short-circuiting portion and the protruding portion that are formed on the second surface, which is a different surface from the first surface, and further includes the second ground portion in a manner that the second ground portion sandwiches a tapered section of the taper portion. Furthermore, in the pattern antenna, the coil (e.g., the coil constituting a matching circuit) is disposed between a point on the second ground portion (a point, on the second ground portion, disposed in a region including the protruding portion among two regions that are defined by splitting a space including the pattern antenna by the center straight line) and a point included in the tip of the taper portion. This achieves excellent broadband antenna characteristics in the pattern antenna. Also, in the pattern antenna, connecting an end of a capacitor to the point included in the tip of the taper portion and the other end of the capacitor to a signal source allows a matching circuit to be constituted with the above-described coil.

What is claimed is:

1. A pattern antenna comprising:

a substrate;

a first ground portion formed on a first surface of the substrate;

an antenna element portion including a conductor pattern in which a plurality of bent portions are formed, the conductor pattern being formed on the first surface of the substrate and being electrically connected to the first ground portion;

a short-circuiting portion including a conductor pattern formed in a second surface, which is a different surface from the first surface, the conductor pattern being formed so as to at least partially overlap with the conductor pattern of the antenna element portion as viewed in planar view, the short-circuiting portion including:

a taper portion with a tapered shape, a feed point being disposed at the tip of the taper portion or in proximity of the tip of the taper portion; and an extended portion extended toward a side opposite to the feed point as viewed in planar view, the extended portion being electrically connected to the taper portion;

a connection portion configured to electrically connect the conductor pattern of the antenna element portion with the conductor pattern of the short-circuiting portion;

a second ground portion, with no contact with the taper portion, with such a shape that sandwiches at least a part of a tapered section of the taper portion as viewed in planar view; and a protruding portion electrically connected to the short-circuiting portion on the second surface of the substrate, the protruding portion including a conductor pattern formed so as to at least partially overlap with the conductor pattern of the antenna element portion as viewed in planar view, wherein the taper portion has a shape that forms a substantially isosceles triangle symmetrical with respect to a center straight line connecting the tip of the taper portion and the center of the tapered section of the taper portion as viewed in planar view, and the taper portion and the second ground portion are disposed such that relations below are satisfied:

$$d1<d2$$

$$wb1<wb2$$

$$wb1<d1$$

$$wb2<d2$$

where a first intersection and a second intersection are two points at which a straight line orthogonal to the center straight line at the tip of the taper portion intersects a contour line of the second ground portion as viewed in planar view, a third intersection and a fourth intersection are two points at which a straight line, which includes a first reference point on the center straight line, the first reference point being included in a region sandwiched by the second ground portion and also being included in the taper portion as viewed in planar view, orthogonal to the center straight line intersects a contour line of the second ground portion, d1 is a distance from the first intersection to the second intersection as viewed in planar view, d2 is a distance from the third intersection to the fourth intersection as viewed in planar view, wb1 is a width, on a straight line connecting the first intersection and the second intersection, of the taper portion as viewed in planar view, and wb2 is a width, on a straight line connecting the third intersection and the fourth intersection, of the taper portion as viewed in planar view.

2. The pattern antenna according to claim 1, further comprising:

a coil an end of which is connected to the tip of the taper portion and the other end of which is connected to a point on the second ground portion that is disposed in the same direction as a direction in which the protruding portion is disposed, as viewed in planar view.

3. The pattern antenna according to claim 1, further comprising:

a coil an end of which is connected to the tip of the taper portion and the other end of which is connected to a point on the second ground portion, the point being disposed in a region including the protruding portion among two regions that are defined by splitting a space including the pattern antenna by the center straight line, as viewed in planar view.

* * * * *